US010910779B2

(12) United States Patent
Amemori et al.

(10) Patent No.: US 10,910,779 B2
(45) Date of Patent: Feb. 2, 2021

(54) BOARD-TO-BOARD ELECTRICAL CONNECTOR SET HAVING PROJECTING PORTIONS AND GUIDING PORTIONS

(71) Applicant: Murata Manufacturing Co., Ltd., Kyoto-fu (JP)

(72) Inventors: Yuma Amemori, Nagaokakyo (JP); Mitsuo Iwata, Nagaokakyo (JP); Yukihiro Kitaichi, Nagaokakyo (JP); Shingo Nakamura, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/749,913

(22) Filed: Jan. 22, 2020

(65) Prior Publication Data

US 2020/0161816 A1 May 21, 2020

Related U.S. Application Data

(63) Continuation of application No. PCT/JP2018/020057, filed on May 24, 2018.

(30) Foreign Application Priority Data

Jul. 24, 2017 (JP) ..... 2017-142562

(51) Int. Cl.
*H01R 12/71* (2011.01)
*H01R 24/60* (2011.01)
(Continued)

(52) U.S. Cl.
CPC ..... *H01R 24/60* (2013.01); *H01R 13/6592* (2013.01); *H01R 12/52* (2013.01);
(Continued)

(58) Field of Classification Search
CPC ..... H01R 12/716; H01R 12/73; H01R 12/79; H01R 12/7082; H01R 13/642;
(Continued)

(56) References Cited

U.S. PATENT DOCUMENTS 8,758,029 B2 * 6/2014 Midorikawa ..... H01R 13/2407 439/74
9,196,984 B2 * 11/2015 Ishida ..... H01R 12/716
(Continued)

FOREIGN PATENT DOCUMENTS

JP 2008-226477 A 9/2008
JP 2015-082446 A 4/2015
(Continued)

OTHER PUBLICATIONS

International Search Report issued in PCT/JP2018/020057; dated Aug. 21, 2018.
(Continued)

*Primary Examiner* — Abdullah A Riyami
*Assistant Examiner* — Justin M Kratt
(74) *Attorney, Agent, or Firm* — Studebaker & Brackett PC

(57) ABSTRACT

A connector including a first connector and a second connector configured to face each to fit together. The first connector includes a first internal terminal including terminals along a longitudinal direction, a first insulating member supporting the first internal terminal, and first external terminals at two ends of the first internal terminal in the longitudinal direction. The second connector includes a second internal terminal including terminals along a longitudinal direction and that engages with the first internal terminal, a second insulating member supporting the second internal terminal, and second external terminals at two ends of the second internal terminal in the longitudinal direction.
(Continued)

The first connector includes projecting portions that project further toward the second connector than the first internal terminal does in a fitting direction. The second connector includes recesses that accommodate the projecting portions and guiding portions, each being in a vicinity of one of the recesses.

18 Claims, 8 Drawing Sheets

(51) Int. Cl.

| | |
|---|---|
| ***H01R 13/6592*** | (2011.01) |
| *H01R 107/00* | (2006.01) |
| *H01R 24/58* | (2011.01) |
| *H01R 24/86* | (2011.01) |
| *H01R 12/77* | (2011.01) |
| *H01R 12/78* | (2011.01) |
| *H01R 12/79* | (2011.01) |
| *H01R 12/73* | (2011.01) |
| *H01R 13/642* | (2006.01) |
| *H01R 12/52* | (2011.01) |
| *H01R 12/62* | (2011.01) |
| *H01R 12/70* | (2011.01) |

(52) U.S. Cl.
CPC ..... *H01R 12/62* (2013.01); *H01R 12/7082* (2013.01); *H01R 12/71* (2013.01); *H01R 12/716* (2013.01); *H01R 12/73* (2013.01); *H01R 12/77* (2013.01); *H01R 12/78* (2013.01); *H01R 12/79* (2013.01); *H01R 13/642* (2013.01); *H01R 24/58* (2013.01); *H01R 24/86* (2013.01); *H01R 2107/00* (2013.01)

(58) Field of Classification Search
CPC ..... H01R 12/78; H01R 24/58; H01R 24/86; H01R 12/52; H01R 12/62; H01R 12/71; H01R 12/77
USPC ..... 439/74, 347, 345
See application file for complete search history.

(56) References Cited

U.S. PATENT DOCUMENTS

| | | | | |
|---|---|---|---|---|
| 2006/0264074 | A1* | 11/2006 | Chang | H01R 12/707 439/74 |
| 2010/0291776 | A1* | 11/2010 | Huang | H01R 12/716 439/74 |
| 2013/0330943 | A1* | 12/2013 | Sasaki | H01R 12/716 439/74 |
| 2014/0363991 | A1* | 12/2014 | Ryan | H01R 12/73 439/74 |
| 2016/0315430 | A1* | 10/2016 | Takeuchi | H01R 12/00 |

FOREIGN PATENT DOCUMENTS

| | | | |
|---|---|---|---|
| JP | 2016-085994 | A | 5/2016 |
| JP | 2016-129148 | A | 7/2016 |
| JP | 2017-007793 | A | 1/2017 |
| JP | 2017-016891 | A | 1/2017 |
| JP | 2017-016897 | A | 1/2017 |

OTHER PUBLICATIONS

International Preliminary Report on Patentability and Written Opinion issued in PCT/JP2018/020057; dated Jan. 28, 2020.

* cited by examiner

BOARD-TO-BOARD ELECTRICAL CONNECTOR SET HAVING PROJECTING PORTIONS AND GUIDING PORTIONS

CROSS-REFERENCE TO RELATED APPLICATIONS

This application claims benefit of priority to International Patent Application No. PCT/JP2018/020057, filed May 24, 2018, and to Japanese Patent Application No. 2017-142562, filed Jul. 24, 2017, the entire contents of each are incorporated herein by reference.

BACKGROUND

Technical Field

The present embodiment relates to a connector set which includes a first connector having a first internal terminal and a second connector having a second internal terminal that engages with the first internal terminal.

Background Art

When a first connector having a male internal terminal and a second connector having a female internal terminal are fitted together, there are variations in the positioning accuracy of the first connector and the second connector, and it is difficult to correctly fit the first connector and the second connector together. Accordingly, it is known that a guiding portion that guides the male internal terminal of the first connector to a correct position is included in the second connector having the female internal terminal so as to lead the first connector to a correct position as described, for example, in Japanese Unexamined Patent Application Publication No. 2016-85994.

SUMMARY

However, in the related art, in the first connector having the male internal terminal, a second reinforcement metal fitting that corresponds to the guiding portion of the second connector having the female internal terminal has a height lower than that of the male internal terminal in a thickness direction (a fitting direction). Thus, there is a possibility that the male internal terminal will come into contact with the female internal terminal at an incorrect position before the first connector is guided to a correct position by the guiding portion, that is, in a state where the first connector has not been guided sufficiently. Therefore, there is a possibility that any one of the internal terminals will be deformed, and in the worst case, there is a possibility that the connectors cannot be fitted together.

Accordingly, the present embodiment provides a connector set capable of suppressing internal terminals of first and second connectors from coming into contact with each other at an incorrect position when the first and second connectors are fitted together and capable of suppressing the first and second connectors from becoming unable to fit together.

A connector set according to the present embodiment includes a first connector and a second connector that can face each other to fit together. The first connector includes a first internal terminal that includes terminals along a longitudinal direction, a first insulating member that supports the first internal terminal, and first external terminals that are at two ends of the first internal terminal in the longitudinal direction. The second connector includes a second internal terminal that includes terminals along a longitudinal direction and that engages with the first internal terminal of the first connector, a second insulating member that supports the second internal terminal, and second external terminals that are at two ends of the second internal terminal in the longitudinal direction. The first connector includes projecting portions that project further toward the second connector than the first internal terminal does in a direction in which the first connector and the second connector are fitted together. The second connector includes recesses in which the projecting portions of the first connector are accommodated and guiding portions each of which is in a vicinity of one of the recesses.

In the connector set according to the present embodiment, each of the first external terminals is larger in height than the first internal terminal in the first connector. Each of the guiding portions is larger in height than the second internal terminal in the second connector. Accordingly, when the first connector and the second connector are fitted together, the first external terminals of the first connector and the guiding portions of the second connector come into contact with each other before the first and second internal terminals come into contact with each other. This makes it easier to guide the first connector to a correct position, so that deformation of the first internal terminal and the second internal terminal can be suppressed, and the probability that the first connector and the second connector may become unable to fit together can be reduced.

DETAILED DESCRIPTION

Figure 1:
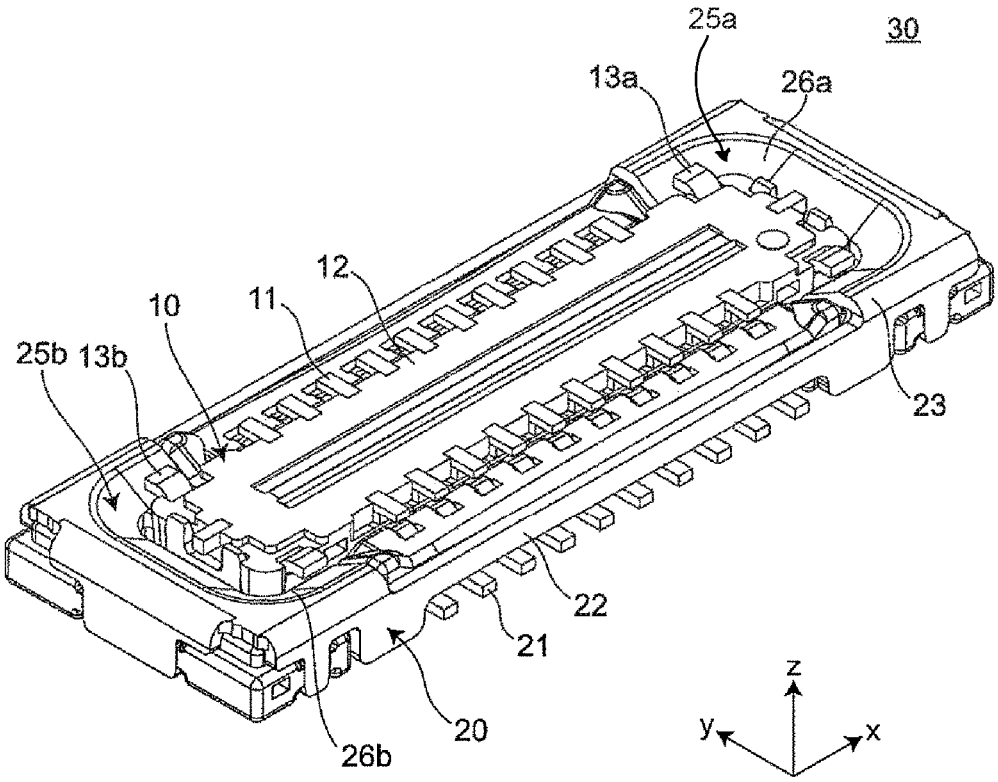
FIG. 1 is a schematic perspective view illustrating a configuration of a connector set according to a first embodiment.

A connector set according to a first aspect is a connector set that includes a first connector and a second connector that can face each other to fit together. The first connector includes a first internal terminal that includes terminals along a longitudinal direction, a first insulating member that supports the first internal terminal, and first external terminals that are at two ends of the first internal terminal in the longitudinal direction. The second connector includes a second internal terminal that includes terminals along a longitudinal direction and that engages with the first internal terminal of the first connector, a second insulating member that supports the second internal terminal, and second external terminals that are at two ends of the second internal terminal in the longitudinal direction. The first connector includes projecting portions that project further toward the second connector than the first internal terminal does in a direction in which the first connector and the second connector are fitted together. The second connector includes recesses in which the projecting portions of the first connector are accommodated and guiding portions each of which is in a vicinity of one of the recesses.

With the above-described configuration, in the first connector, the first external terminals include projecting portions each of which is larger in height than the first internal terminal. In the second connector, each of the guiding portions is larger in height than the second internal terminal. Accordingly, when the first connector and the second connector are fitted together, the projecting portions of the first connector and the guiding portions of the second connector come into contact with each other before the first and second internal terminals come into contact with each other. This makes it easier to guide the first connector to a correct position, so that deformation of the first internal terminal and the second internal terminal can be suppressed, and the probability that the first connector and the second connector may become unable to fit together can be reduced.

In a connector set according to a second aspect, the guiding portions may project further toward the first connector than the second internal terminal does in the direction in which the first connector and the second connector are fitted together in the above-described first aspect.

In a connector set according to a third aspect, each of the projecting portions of the first connector in the above-described first or second aspect may be provided as a portion of one of the first external terminals.

In a connector set according to a fourth aspect, each of the projecting portions of the first connector in any one of the above-described first to third aspects may be made of a metal.

With the above-described configuration, the wear resistance of each of the projecting portions of the first connector can be improved.

In a connector set according to a fifth aspect, each of the guiding portions of the second connector in any one of the above-described first to fourth aspects may have an inclined surface that is in the vicinity of one of the recesses and that is inclined toward the recess.

In a connector set according to a sixth aspect, in the direction in which the first connector and the second connector are fitted together, a difference in height between each of the projecting portions of the first connector and the first internal terminal may be equal to or larger than a difference in height between the second internal terminal of the second connector and a lower end portion of the inclined surface of each of the guiding portions in the above-described fifth aspect.

In a connector set according to a seventh aspect, each of the recesses of the second connector in any one of the above-described first to sixth aspects may be a through hole that extends through the second connector.

With the above-described configuration, the height of each of the projecting portions of the first connector can be approximately equal to the height of each of the through holes of the second connector. By increasing the height of each of the projecting portions to its limit in this manner, the efficiency of guiding the first connector can be further improved. In addition, by forming the through holes, increase in the height of a product when the first connector and the second connector are fitted together can be suppressed.

In a connector set according to an eighth aspect, each of the guiding portions of the second connector in any one of the above-described first to seventh aspects may be provided as a portion of one of the second external terminals.

In a connector set according to a ninth aspect, each of the guiding portions of the second connector in any one of the above-described first to eighth aspects may be made of a metal.

With the above-described configuration, the wear resistance of each of the guiding portions of the second connector can be improved.

In a connector set according to a tenth aspect, the first connector in any one of the above-described first to ninth aspects may include to-be-guided portions each of which is made of a metal, and the to-be-guided portions may each have three surfaces perpendicular to a fitting plane in which the first connector and the second connector are fitted together and a convex surface that connects the three surfaces in a contiguous manner.

With the above-described configuration, since the to-be-guided portions are each made of a metal, the wear resistance of each of the to-be-guided portions can be improved. In addition, since the to-be-guided portions each have the three surfaces perpendicular to the fitting plane in which the first connector and the second connector are fitted together and the convex surface that connects the three surfaces in a contiguous manner, an acceptable range of positional deviation in which the first connector can be guided is wide.

In a connector set according to an eleventh aspect, each of the to-be-guided portions of the first connector in the above-described tenth aspect may be provided as a portion of one of the first external terminals.

A connector set according to an embodiment will be described below with reference to the accompanying drawings. Note that, in the drawings, members that are substantially the same as each other are denoted by the same reference signs.

First Embodiment

<Connector Set>

Figure 2:
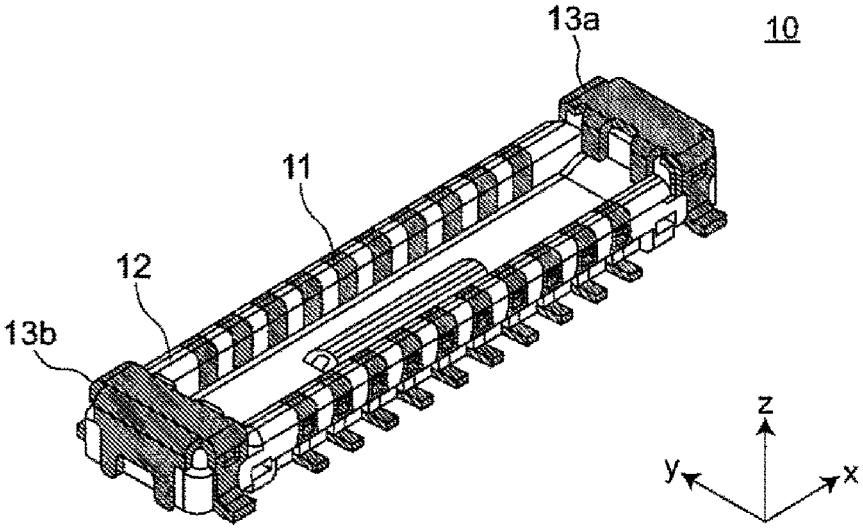
FIG. 2 is a schematic perspective view of a first connector included in the connector set illustrated in FIG. 1.
Figure 3:
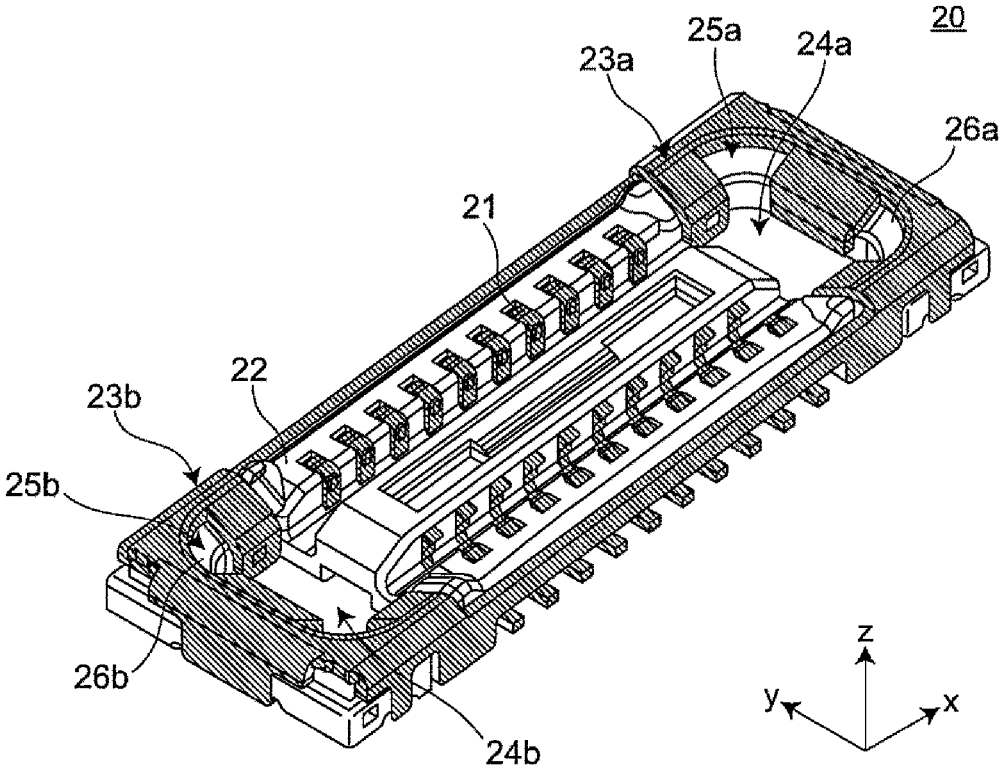
FIG. 3 is a schematic perspective view of a second connector included in the connector set illustrated in FIG. 1.

FIG. 1 is a schematic perspective view illustrating the configuration of a connector set 30 according to a first embodiment. FIG. 2 is a schematic perspective view of a first connector 10 included in the connector set 30 illustrated in FIG. 1. FIG. 3 is a schematic perspective view of a second connector 20 included in the connector set 30 illustrated in FIG. 1. Note that, in FIG. 1 to FIG. 3, the x-axis, the y-axis, and the z-axis that are perpendicular to one another are illustrated for convenience of description.

In the connector set 30 according to the first embodiment, the first connector 10 and the second connector 20 can face each other to fit together. The first connector 10 includes a first internal terminal 11, a first insulating member 12, and two first external terminals 13*a* and 13*b*. The first internal terminal 11 includes one or a plurality of protruding terminals along the longitudinal direction (the x-axis direction). The first internal terminal 11 is supported by the first insulating member 12. The two first external terminals 13*a* and 13*b* are at the opposite ends of the first internal terminal 11 in the longitudinal direction (the x-axis direction) so as to be spaced apart from each other. The second connector 20 includes a second internal terminal 21, a second insulating member 22, and two second external terminals 23, which are referred to as second external terminals 23*a* and 23*b* as indicated in FIGS. 3, 5A-5C, 6A, 6B, 8A and 8B. The second internal terminal 21 includes one or a plurality of recessed terminals along the longitudinal direction (the x-axis direction) and engages with the first internal terminal 11 of the first connector 10. The second internal terminal 21 is supported by the second insulating member 22. The second external terminals 23*a* and 23*b* are at the opposite ends of the second internal terminal 21 in the longitudinal direction (the x-axis direction) so as to be spaced apart from each other.

The first connector 10 includes projecting portions (the first external terminals 13*a* and 13*b*) that project further toward the second connector 20 than the first internal terminal 11 does in a direction (the z-axis direction, which is a fitting direction) perpendicular to a fitting plane (an x-y plane) in which the first connector 10 and the second connector 20 are fitted together. The second connector 20 has recesses 24*a* and 24*b* in which the projecting portions of the first connector 10 are accommodated and guiding portions 25*a* and 25*b* that are in the vicinity of the recesses 24*a* and 24*b* and that project further toward the first connector 10 than the second internal terminal 21 does in the direction (the z-axis direction) perpendicular to the fitting plane, in which the first connector 10 and the second connector 20 are fitted together.

With the above-described configuration, when the first connector 10 and the second connector 20 are fitted together, the first external terminals 13*a* and 13*b*, each of which is larger in height than the first internal terminal 11, and the guiding portions 25*a* and 25*b*, each of which is larger in height than the second internal terminal 21, come into contact with each other before the first and second internal terminals 11 and 21 come into contact with each other. This makes it easy to guide the first connector 10 to a correct position. In other words, a guiding efficiency at the time of fitting the connectors is improved, and smooth fitting can be performed. As a result, deformation of the first internal terminal 11 and the second internal terminal 21 can be suppressed, and the probability that the first connector 10 and the second connector 20 may become unable to fit together can be reduced.

Each member included in the connector set will be described below.

<First Connector>

Figure 4A:
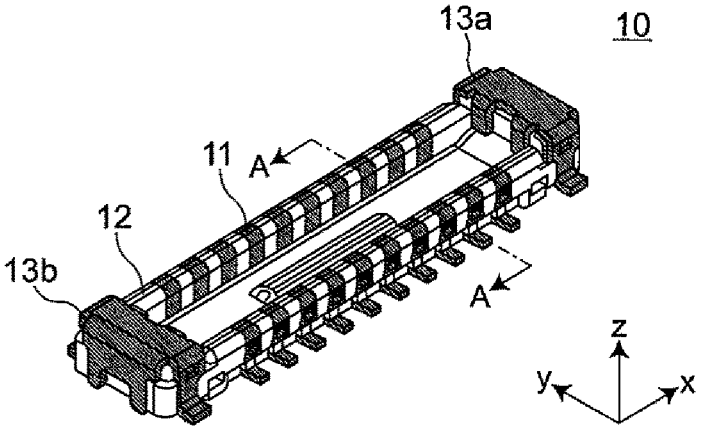
FIG. 4A is a schematic perspective view illustrating a configuration of the first connector.
Figure 4B:
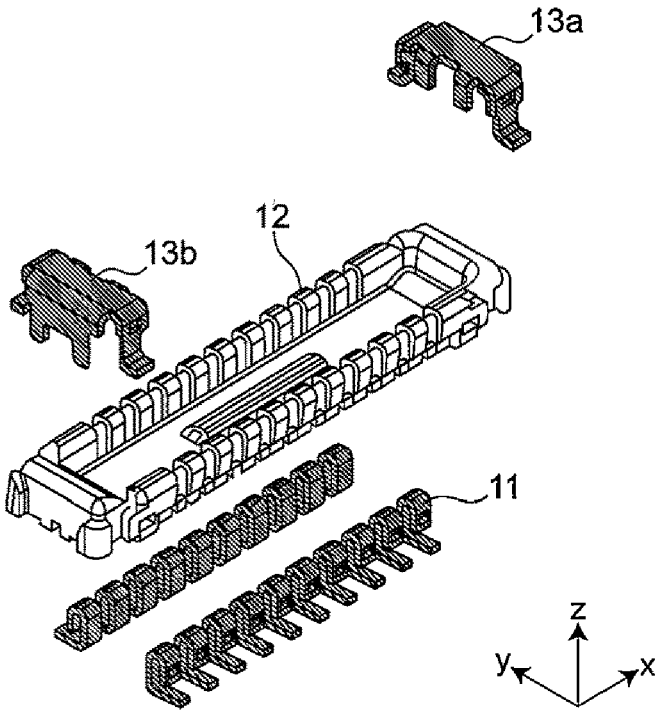
FIG. 4B is an exploded perspective view of the first connector illustrated in FIG. 4A.
Figure 4C:
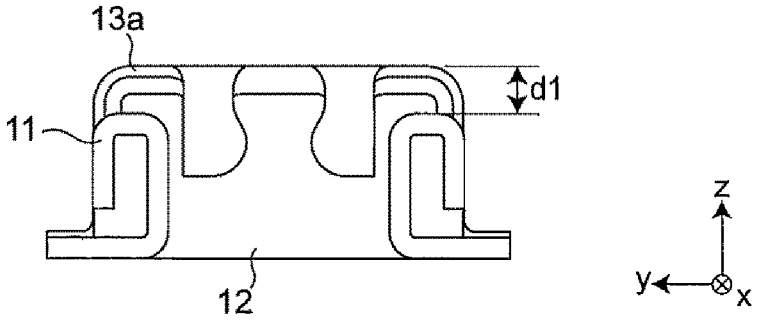
FIG. 4C is a schematic cross-sectional view of a sectional structure taken along line A-A of FIG. 4A.

FIG. 4A is a schematic perspective view illustrating the configuration of the first connector 10. FIG. 4B is an exploded perspective view of the first connector 10 illustrated in FIG. 4A. FIG. 4C is a schematic cross-sectional view of a sectional structure taken along line A-A of FIG. 4A. Note that, in FIG. 4A to FIG. 4C, the x-axis, the y-axis, and the z-axis that are perpendicular to one another are illustrated for convenience of description.

The first connector 10 includes the first internal terminal 11, the first insulating member 12, and the two first external terminals 13*a* and 13*b*. In addition, the first connector 10 includes the projecting portions projecting further toward the second connector 20 than the first internal terminal 11 does in the direction (the fitting direction) perpendicular to the fitting plane, in which the first connector 10 and the second connector 20 are fitted together.

<First Internal Terminal>

The first internal terminal 11 includes one or a plurality of protruding terminals along the longitudinal direction. Thus, the first internal terminal 11 is also usually called a male internal terminal. The first internal terminal 11 is, for example, a conductor that is connected to a signal potential or a ground potential and is formed by bending a bar-shaped member having electrical conductivity. In addition, for example, the first internal terminal 11 is supported by being fitted into a groove of the first insulating member 12. For example, phosphor bronze can be used as the material of the first internal terminal 11. Phosphor bronze is a material that has electrical conductivity and that is capable of being elastically deformed.

As illustrated in FIG. 4A, the first internal terminal 11 includes two rows of protruding terminals extending in the longitudinal direction, and each of the rows includes ten protruding terminals. Note that the number of the rows is not limited to two, and three or more rows may be provided. In order to suppress interference of electromagnetic waves between the rows included in the first internal terminal 11, an electrically conductive shield member (not illustrated) may be provided between the rows in the first internal terminal 11. For example, the shield member may be supported by being fitted into a center groove of the first insulating member 12. In addition, the shield member may extend in the longitudinal direction between the rows in the first internal terminal 11.

Note that, in the present embodiment, although one or a plurality of protruding terminals are in the first internal terminal 11, the first internal terminal 11 is not limited to having this configuration, and one or a plurality of recessed terminals may be arranged. In this case, in the second internal terminal 21 that engages with the first internal terminal 11, one or a plurality of protruding terminals are arranged instead of one or a plurality of recessed terminals.

<First External Terminals>

The first external terminals 13*a* and 13*b* are at the opposite ends of the first internal terminal 11 in the longitudinal direction so as to be spaced apart from each other. Note that, as illustrated in FIG. 4A and FIG. 4B, although the two first external terminals 13*a* and 13*b* are isolated from each other, the present embodiment is not limited to this configuration, and the first external terminals 13*a* and 13*b* may be connected to each other. In this case, the first external terminals 13*a* and 13*b* may be a continuous member.

For example, the first external terminals 13*a* and 13*b* are conductors that are connected to the ground potential. The first external terminals 13*a* and 13*b* are maintained at the ground potential by being connected to the ground potential, so that the first external terminals 13*a* and 13*b* block radio waves from the outside of the first connector 10 and can form an electrically shielded space in the first connector 10. In other words, the first external terminals 13*a* and 13*b* are also particularly useful as members that prevent the radio waves from the outside of the first connector 10 from interfering with the first internal terminal 11. For example, phosphor bronze can be used as the material of the first external terminals 13*a* and 13*b*. Phosphor bronze is a material that has electrical conductivity and that is capable of being elastically deformed. Note that, surfaces of the first external terminals 13*a* and 13*b* may be coated with, for example, gold. For example, the first external terminals 13*a* and 13*b* are formed by bending.

<First Insulating Member>

The first insulating member 12 supports the first internal terminal 11 and also supports the first external terminals 13*a* and 13*b* integrally. For example, a resin such as a liquid crystal polymer may be used as the material of the first insulating member 12. A resin case may be formed as the first insulating member 12. In addition, for example, the first internal terminal 11 and the first external terminals 13*a* and 13*b* may be integrally molded with the first insulating member 12, which is made of a resin, into the single first connector 10 by insert molding.

<Projecting Portions>

As illustrated in the cross-sectional view in FIG. 4C, each of the first external terminals 13*a* and 13*b* is a projecting portion that projects toward the second connector 20 by a projection amount d1 relative to the first internal terminal 11 in the direction perpendicular to the fitting plane, in which the first connector 10 and the second connector 20 are fitted together. In other words, the projecting portions are provided as portions of the first external terminals 13*a* and 13*b*. The first external terminals 13*a* and 13*b* are each formed to have a large height in a thickness direction (the z-axis direction) in order to improve the guiding efficiency.

Note that the projecting portions are not limited to being provided as portions of the above-mentioned first external terminals and may be provided as members that are different from the first external terminals. In addition, the projecting portions are not limited to being made of a metal and may be made of a resin.

<Second Connector>

Figure 5A:
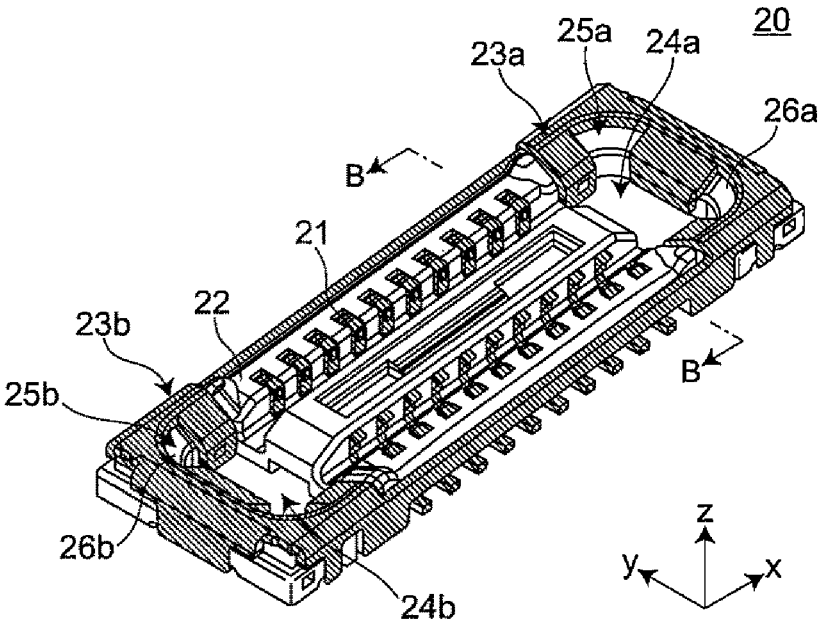
FIG. 5A is a schematic perspective view illustrating a configuration of the second connector.
Figure 5B:
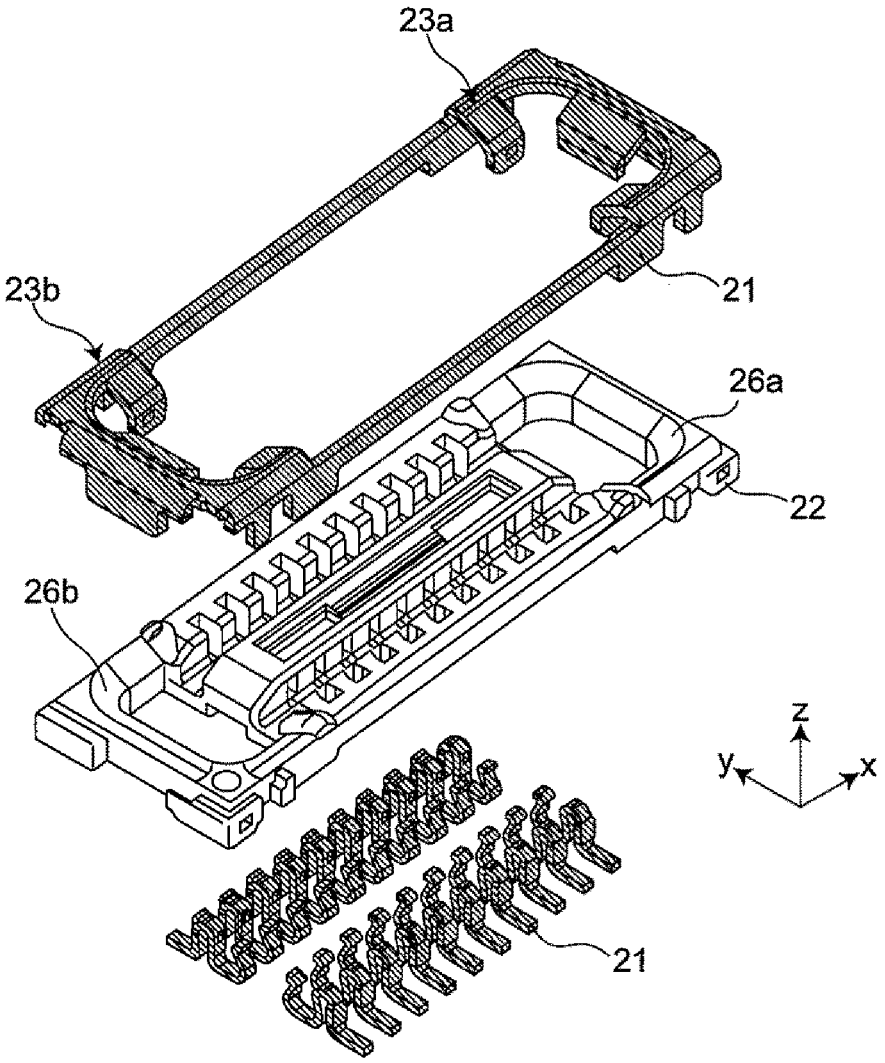
FIG. 5B is an exploded perspective view of the second connector illustrated in FIG. 5A.
Figure 5C:
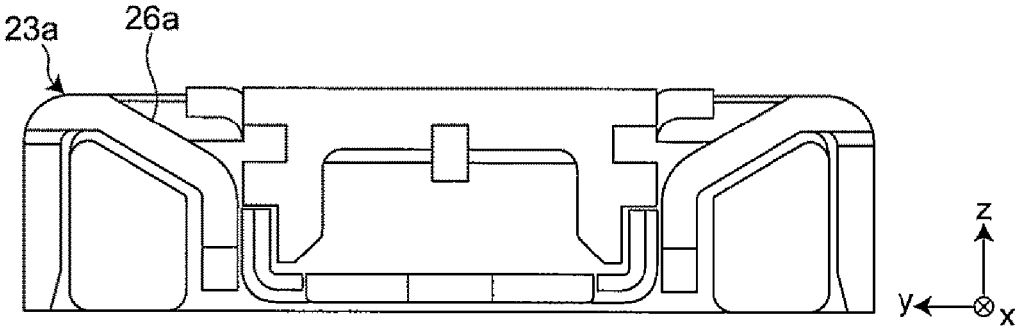
FIG. 5C is a schematic cross-sectional view of a sectional structure taken along line B-B of FIG. 5A.

FIG. 5A is a schematic perspective view illustrating the configuration of the second connector 20. FIG. 5B is an exploded perspective view of the second connector 20 illustrated in FIG. 5A. FIG. 5C is a schematic cross-sectional view of a sectional structure taken along line B-B of FIG. 5A. Note that, in FIG. 5A to FIG. 5C, the x-axis, the y-axis, and the z-axis that are perpendicular to one another are illustrated for convenience of description.

The second connector 20 includes the second internal terminal 21, the second insulating member 22, and the second external terminals 23*a* and 23*b*. The second connector 20 surrounds the first connector 10 from the outside and has a size larger than that of the first connector 10.

The second connector has the recesses 24*a* and 24*b* in which the projecting portions of the first connector 10 are accommodated and the guiding portions 25*a* and 25*b* that are in the vicinity of the recesses 24*a* and 24*b* and that project further toward the first connector 10 than the second internal terminal 21 does in the direction perpendicular to the fitting plane, in which the first connector 10 and the second connector 20 are fitted together.

<Second Internal Terminal>

The second internal terminal 21 includes one or a plurality of recessed terminals along the longitudinal direction. Thus, the second internal terminal 21 is also usually called a female internal terminal. The second internal terminal engages with the first internal terminal 11 of the first connector 10. The second internal terminal 21 is, for example, a conductor that is connected to a signal potential or a ground potential and is formed by bending a bar-shaped member having electrical conductivity. In addition, for example, the second internal terminal 21 is supported by being fitted into a groove of the second insulating member 22. For example, phosphor bronze can be used as the material of the second internal terminal 21. Phosphor bronze is a material that has electrical conductivity and that is capable of being elastically deformed.

As illustrated in FIG. 5A, the second internal terminal 21 includes two rows of recessed terminals extending in the longitudinal direction, and each of the rows includes ten recessed terminals. Note that the number of the rows is not limited to two, and three or more rows may be provided. The recessed terminals come into contact and engage with the protruding terminals of the first internal terminal 11 in a one-to-one relationship. When engaging, inner end portions of the recessed terminals are opened so as to engage with the protruding terminals. In order to suppress interference of electromagnetic waves between the rows included in the second internal terminal 21, an electrically conductive shield member (not illustrated) may be provided between the rows in the second internal terminal 21. For example, the shield member may be supported by being fitted into a center groove of the second insulating member 22. In addition, the shield member may extend in the longitudinal direction between the rows in the second internal terminal 21.

Note that, in the present embodiment, although one or a plurality of recessed terminals are in the second internal terminal 21, the second internal terminal 21 is not limited to having this configuration, and one or a plurality of protruding terminals may be arranged. In this case, in the first internal terminal 11 that engages with the second internal terminal 21, one or a plurality of recessed terminals are arranged instead of one or a plurality of protruding terminals.

The second external terminals 23*a* and 23*b* are at the opposite ends of the second internal terminal 21 in the longitudinal direction (the x-axis direction) so as to be spaced apart from each other. Note that, as illustrated in FIG. 5A and FIG. 5B, although the second external terminals 23*a* and 23*b* are in an annular shape so as to surround the second connector 20, the present embodiment is not limited to this configuration, and for example, the second external terminals 23*a* and 23*b* may be separated into two portions that are provided at opposite ends.

For example, the second external terminals 23*a* and 23*b* are conductors that are connected to the ground potential. The second external terminals 23*a* and 23*b* are maintained at the ground potential by being connected to the ground potential, so that the second external terminals 23*a* and 23*b* block radio waves from the outside of the second connector 20 and can form an electrically shielded space in the second connector 20. In other words, the second external terminals

23*a* and 23*b* are also particularly useful as members that prevent the radio waves from the outside of the second connector 20 from interfering with the second internal terminal 21. For example, phosphor bronze can be used as the material of the second external terminals 23*a* and 23*b*. Phosphor bronze is a material that has electrical conductivity and that is capable of being elastically deformed. For example, the second external terminals 23*a* and 23*b* are formed by bending.

<Second Insulating Member>

The second insulating member 22 supports the second internal terminal 21 and also supports the second external terminals 23*a* and 23*b* integrally. For example, a resin may be used as the material of the second insulating member 22. The second internal terminal 21 may be built into the second insulating member 22 by press fitting. Alternatively, for example, the second internal terminal 21 and the second external terminals 23*a* and 23*b* may be integrally molded with the second insulating member 22, which is made of a resin, into the single second connector 20 by insert molding.

<Recesses>

The first external terminals 13*a* and 13*b*, which are the projecting portions of the first connector 10, are accommodated in the recesses 24*a* and 24*b*, respectively. Note that each of the recesses 24*a* and 24*b* may be a hole having a resin bottom or may be a through hole that does not have a resin bottom. By forming the recesses 24*a* and 24*b* as through holes, the height of each of the first external terminals 13*a* and 13*b*, which are the projecting portions of the first connector 10, can be approximately equal to the height of each of the through holes of the second connector 20. By increasing the height of each of the projecting portions to its limit in this manner, the efficiency of guiding the first connector 10 can be further improved. In addition, by forming such through holes, the through holes can accommodate the height of each of the first external terminals 13*a* and 13*b*, which are the projecting portions of the first connector 10, and thus, the height of a product (the connector set) can be suppressed from becoming unnecessarily large when the first connector 10 and the second connector 20 are fitted together.

<Guiding Portions (Leading Portions)>

The guiding portions 25*a* and 25*b* are in the vicinity of the recesses 24*a* and 24*b* and project further toward the first connector 10 than the second internal terminal 21 does in the direction perpendicular to the fitting plane, in which the first connector 10 and the second connector 20 are fitted together. In other words, the guiding portions 25*a* and 25*b* are each formed to have a large height in the thickness direction (the z-axis direction) in order to improve the efficiency of guiding the first connector 10.

In addition, as illustrated in FIG. 5A, in the second connector 20 included in the connector set 30, the guiding portions 25*a* and 25*b* are respectively formed of the second external terminals 23*a* and 23*b*, which are made of a metal, such that the guiding portion 25*a* extends in a discontinuous manner along three sides (a short side (the y-axis) and portions of long sides at the opposite ends of the short side) at one of the two ends in the longitudinal direction (the x-axis direction) and such that the guiding portion 25*b* extends in a discontinuous manner along other three sides (a short side (the y-axis) and portions of long sides at the opposite ends of the short side) at the other of the two ends in the longitudinal direction. The present embodiment is not limited to this configuration, and as in a third embodiment, which will be described later, each of the guiding portions 25*a* and 25*b* may be provided so as to have three contiguous sides at one of the two ends in the longitudinal direction (the x-axis direction). In addition, each of the guiding portions 25*a* and 25*b* is not limited to being made of a metal and may be formed of a resin member. Alternatively, each of the guiding portions 25*a* and 25*b* may include a portion made of a metal and a portion made of a resin.

<Fitting of First Connector and Second Connector>

Figure 6A:
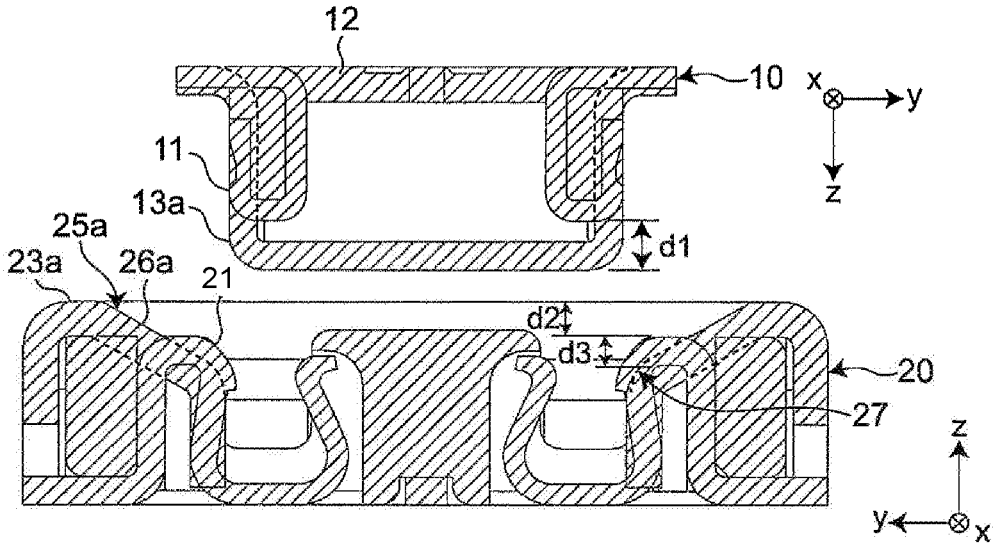
FIG. 6A is a schematic cross-sectional view when external terminals are viewed from the side on which internal terminals are disposed, the view illustrating a state immediately before the first connector illustrated in FIG. 2 and the second connector illustrated in FIG. 3, which are facing each other, are fitted together.
Figure 6B:
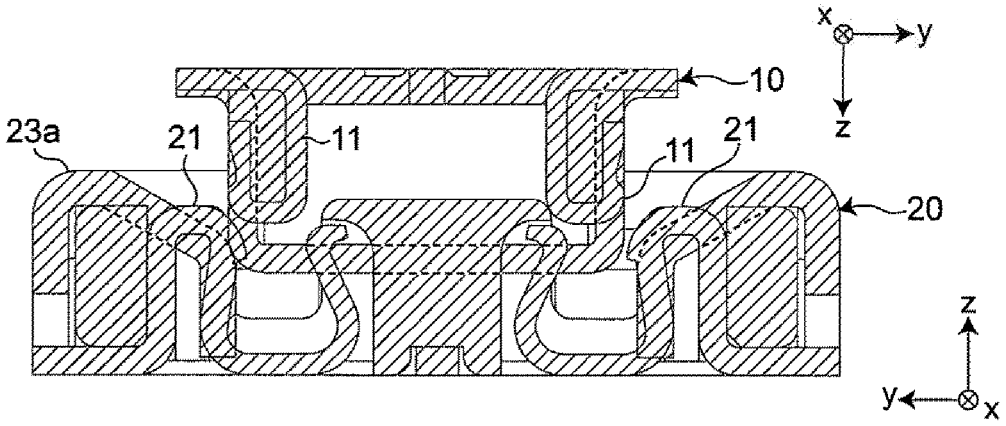
FIG. 6B is a schematic cross-sectional view when the external terminals are viewed from the side on which the internal terminals are disposed, the view illustrating a state where the first connector illustrated in FIG. 2 and the second connector illustrated in FIG. 3 start coming into contact with each other.
Figure 6C:
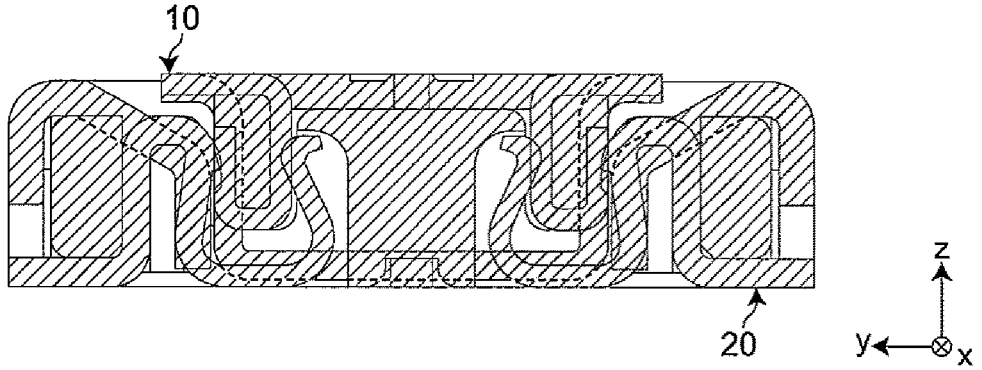
FIG. 6C is a schematic cross-sectional view when the external terminals are viewed from the side on which the internal terminals are disposed, the view illustrating a state where the first connector illustrated in FIG. 2 and the second connector illustrated in FIG. 3 are completely fitted together in the connector set.

FIG. 6A is a schematic cross-sectional view when the first external terminal 13*a* and the second external terminal 23*a* are viewed from the side on which the first internal terminal 11 and the second internal terminal 21 are disposed, the view illustrating a state immediately before the first connector 10 illustrated in FIG. 2 and the second connector 20 illustrated in FIG. 3, which are facing each other, are fitted together. FIG. 6B is a schematic cross-sectional view when the first external terminal 13*a* and the second external terminal 23*a* are viewed from the side on which the first internal terminal 11 and the second internal terminal 21 are disposed, the view illustrating a state where the first connector 10 illustrated in FIG. 2 and the second connector 20 illustrated in FIG. 3 start coming into contact with each other. FIG. 6C is a schematic cross-sectional view when the first external terminal 13*a* and the second external terminal 23*a* are viewed from the side on which the first internal terminal 11 and the second internal terminal 21 are disposed, the view illustrating a state where the first connector 10 illustrated in FIG. 2 and the second connector 20 illustrated in FIG. 3 of the connector set 30 are completely fitted together. Note that, in FIG. 6A to FIG. 6C, the x-axis, the y-axis, and the z-axis that are perpendicular to one another are illustrated for convenience of description. Note that the first connector 10 and the second connector 20 are fitted together such that the z-axis of the first connector 10 and the z-axis of the second connector 20 oppose each other. Thus, when the first connector 10 and the second connector 20 are fitted together, the y-axis of the first connector 10 and the y-axis of the second connector 20 are oriented in opposite directions, and the z-axis of the first connector 10 and the z-axis of the second connector 20 are oriented in opposite directions.

A state when the first connector 10 and the second connector 20 are fitted together will be described below with reference to FIG. 6A to FIG. 6C.

(1) The first connector 10 and the second connector 20 are arranged such that the z-axis of the first connector 10 and the z-axis of the second connector 20 oppose each other (FIG. 6A). As illustrated in FIG. 6A, the first external terminal 13*a* of the first connector 10 projects toward the second connector 20 by the projection amount d1 relative to the first internal terminal 11 in the direction (the z-axis direction, which is the fitting direction) perpendicular to the fitting plane (the x-y plane), in which the first connector 10 and the second connector 20 are fitted together. The second external terminal 23*a* of the second connector 20 projects toward the first connector 10 by a projection amount d2 relative to the second internal terminal 21 in the direction (the z-axis direction) perpendicular to the fitting plane (the x-y plane), in which the first connector 10 and the second connector 20 are fitted together. It is preferable that the projection amount d1 of the first external terminal 13*a* and the projection amount d2 of the second external terminal 23*a* be substantially similar to each other. The guiding portion 25*a* of the second connector 20 has an inclined surface 26*a*, and a lower end portion 27 of the inclined surface 26*a* is lower than the second internal terminal 21 by a height difference d3 in the z-axis direction. Likewise, as further shown, the guiding portion 25*b* of the second connector 20 has an inclined surface 26*b* having features similar to those of inclined surface 26*a* as discussed herein.

(2) Next, the first external terminal 13*a* of the first connector 10 is guided along the inclined surface 26*a* of the guiding portion 25*a*, which is a portion of the second external terminal 23*a* of the second connector 20, to the lower end portion 27 (FIG. 6B). In other words, when the first connector 10 and the second connector 20 are fitted together, the guiding portions 25*a* and 25*b* are brought into contact with the first external terminals 13*a* and 13*b*, which are to-be-guided portions, so as to be positioned, and then, the first internal terminal 11 and the second internal terminal 21 engage each other. As illustrated in FIG. 6B, the first external terminal 13*a* of the first connector 10 is guided along the inclined surface 26*a* of the guiding portion 25*a* of the second connector 20 to the lower end portion 27. At this point, it is preferable that the first internal terminal 11 of the first connector 10 and the second internal terminal 21 of the second connector 20 come into contact with each other. Consequently, it is preferable that the projection amount d1 of the first external terminal 13*a* be larger than the height difference d3 between the lower end portion 27 of the inclined surface 26*a* of the guiding portion 25*a* and the second internal terminal 21.

(3) After that, the first internal terminal 11 of the first connector 10 and the second internal terminal 21 of the second connector 20 engage each other so as to connect the first connector 10 to the second connector 20 in the connector set 30.

In the manner described above, the connector set 30 includes the first connector 10 and the second connector 20 that are configured to face each other to fit together.

Second Embodiment

Figure 7A:
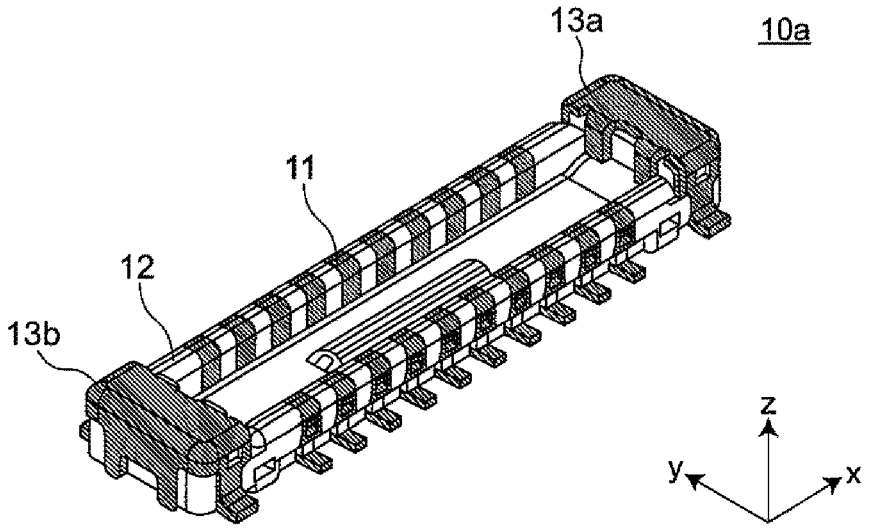
FIG. 7A is a schematic perspective view illustrating a configuration of a first connector included in a connector set according to a second embodiment.
Figure 7B:
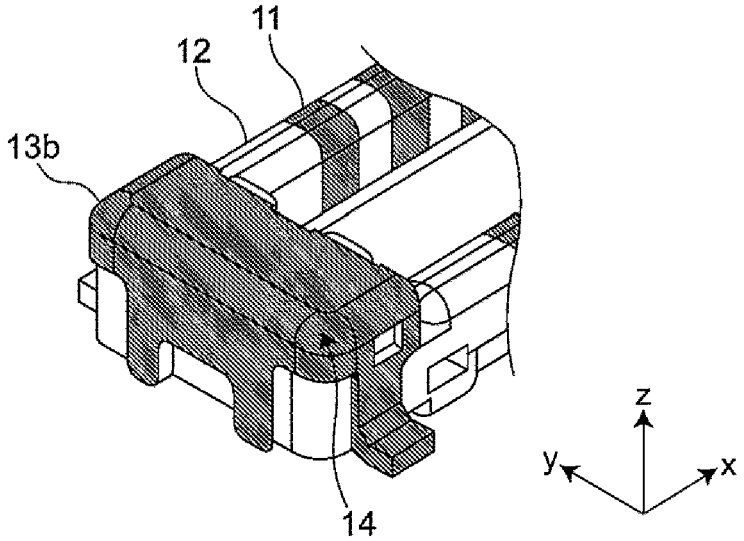
FIG. 7B is a partially enlarged view illustrating one of first external terminals at opposite ends in FIG. 7A.

FIG. 7A is a schematic perspective view illustrating a configuration of a first connector included in a connector set according to a second embodiment. FIG. 7B is a partially enlarged view illustrating one of first external terminals at opposite ends in FIG. 7A. Note that, in FIG. 7A and FIG. 7B, the x-axis, the y-axis, and the z-axis that are perpendicular to one another are illustrated for convenience of description.

When comparing a first connector 10*a* included in the connector set according to the second embodiment and the first connector included in the connector set according to the first embodiment, the difference between the first connector 10*a* and the first connector is that, in the first connector 10*a*, the first external terminals 13*a* and 13*b*, which are to-be-guided portions, each have three surfaces that are perpendicular to a fitting plane in which the first connector 10*a* and the second connector 20 are fitted together and a convex surface 14 that connects the three surfaces in a contiguous manner. In other words, the first external terminals 13*a* and 13*b*, which are to-be-guided portions, are each formed so as to continuously extend from three outer side surfaces of the first connector 10 to the upper surface of the first connector 10 and so as to extend across the adjacent outer side surfaces of the first connector 10 such that end portions (corner portions) of the first insulating member (a resin case) 12 of the first connector 10 are not exposed. As a result, the guiding efficiency when the first connector 10*a* and the second connector 20 are fitted together is improved, and deformation or breakage of the second connector 20 can be suppressed.

Note that the above-mentioned convex surface 14 may be formed by drawing or the like.

Third Embodiment

Figure 8A:
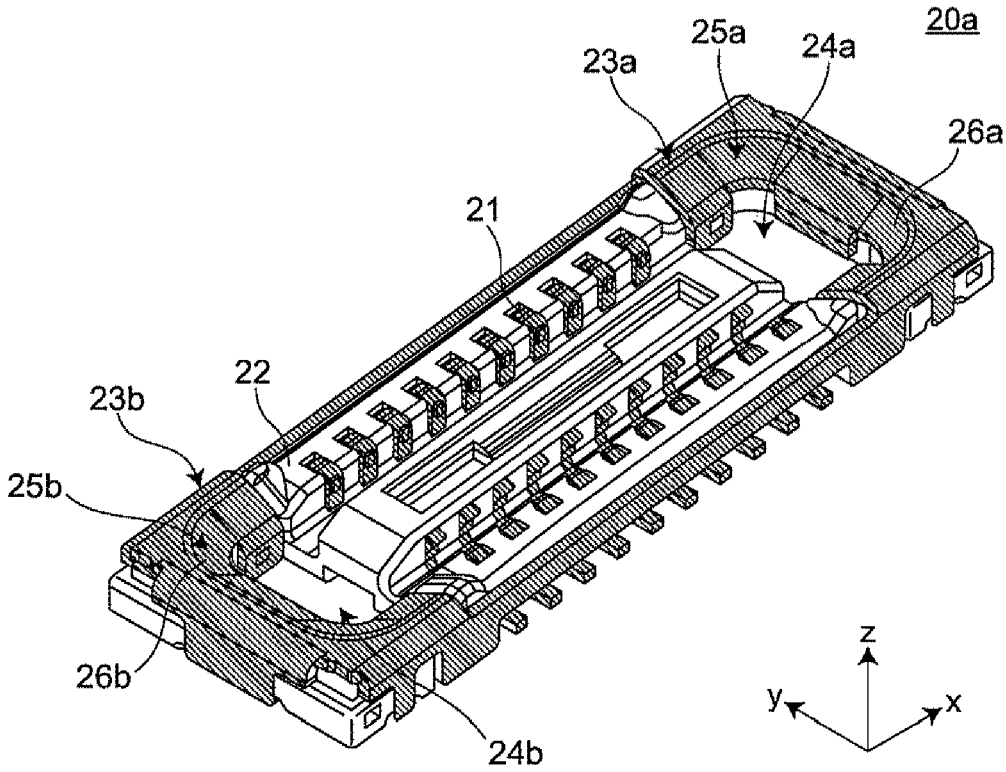
FIG. 8A is a schematic perspective view illustrating a configuration of a second connector included in a connector set according to a third embodiment.
Figure 8B:
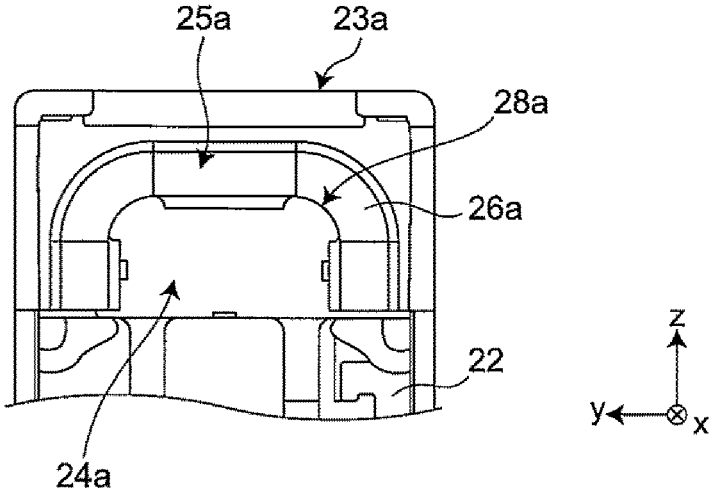
FIG. 8B is a partially enlarged view illustrating one of second external terminals at opposite ends in FIG. 8A.

FIG. 8A is a schematic perspective view illustrating a configuration of a second connector 20*a* included in a connector set according to the third embodiment. FIG. 8B is a partially enlarged view illustrating the second external terminal 23*a*, which is one of the second external terminals 23*a* and 23*b* at opposite ends in FIG. 8A. Note that, in FIG. 8A and FIG. 8B, the x-axis, the y-axis, and the z-axis that are perpendicular to one another are illustrated for convenience of description.

When comparing the second connector 20*a* included in the connector set according to the third embodiment and the second connector included in the connector set according to the first embodiment, the difference between the second connector 20*a* and the second connector is that, in the second connector 20*a*, the guiding portion 25*a* is formed of the second external terminal 23*a* so as to extend along three sides in a continuous manner.

In this manner, as a result of a rounded surface (concave surface) of the second external terminal 23*a*, which is made of a metal, coming into contact with an entire contact surface of the guiding portion 25*a* of the second connector 20 that is brought into contact with the first connector 10, an acceptable range of positional deviation in which the first connector 10 can be guided is wide, and deformation of the resin members included in the second connector 20 can be suppressed. In other words, as a result of the guiding portion 25*a* being formed to have a continuous surface, an operator does not feel some of the terminals getting caught during a guiding operation, and this results in better sensation of the guiding operation. Accordingly, the possibility of deformation of the terminals occurring when improper fitting is performed can be reduced.

The inclined surface 26*a* of the guiding portion 25*a* is formed of a rolled metal surface. In other words, the inclined surface 26*a* is not formed of either a fracture surface of a metal plate or a tapered portion of such a fracture surface and is formed of a rolled metal surface, and thus, the inclined surface 26*a* can be a smooth surface.

In addition, a cutout portion 28*a* is formed in a lower end portion of the inclined surface 26*a* that is formed at a corner of the guiding portion 25*a*. As a result, the press-workability of the second external terminal 23*a* can be improved.

Note that the present disclosure includes suitable combinations of arbitrary embodiments among the above-described various embodiments, and the advantageous effects of the embodiments can be obtained.

A connector set according to the present embodiment makes it easier to guide a first connector to a correct position when the first connector and a second connector are fitted together, so that deformation of first and second internal terminals can be suppressed, and the probability that the first connector and the second connector may become unable to fit together can be reduced. Accordingly, the present embodiment is useful as a connector set.

What is claimed is:

1. A connector set including a first connector and a second connector configured to face each other to fit together, the first connector including a first internal terminal that includes terminals along a longitudinal direction, a first insulating member that supports the first internal terminal, and first external terminals that are at two ends of the first internal terminal in the longitudinal direction, the second connector including a second internal terminal that includes terminals along a longitudinal direction and is configured to engage with the first internal terminal of the first connector, a second insulating member that supports the second internal terminal, and second external terminals that are at two ends of the second internal terminal in the longitudinal direction, wherein the first connector includes projecting portions that project further toward the second connector than the first internal terminal does in a direction in which the first connector and the second connector are fitted together, and each of the projecting portions of the first connector is provided as a portion of one of the first external terminals, and the second connector includes recesses, in which the projecting portions of the first connector are accommodated, and guiding portions, each of the guiding portions surrounding a respective one of the recesses.

2. The connector set according to claim 1, wherein the guiding portions each project further toward the first connector than the second internal terminal does in the direction in which the first connector and the second connector are fitted together.

3. The connector set according to claim 1, wherein each of the projecting portions of the first connector is made of a metal.

4. The connector set according to claim 1, wherein each of the guiding portions of the second connector has an inclined surface that is in the vicinity of one of the recesses and that is inclined toward the recess.

5. The connector set according to claim 4, wherein the inclined surface is continuous surface surrounding the recess.

6. The connector set according to claim 4, wherein each of the guiding portions of the second connector has a plurality of inclined surfaces, the inclined surfaces are each on three sides surrounding the recess.

7. The connector set according to claim 4, wherein in the direction in which the first connector and the second connector are fitted together, a difference in height between each of the projecting portions of the first connector and the first internal terminal is equal to or larger than a difference in height between the second internal terminal of the second connector and a lower end portion of the inclined surface of each of the guiding portions.

8. The connector set according to claim 1, wherein each of the recesses of the second connector is a through hole that extends through the second connector.

9. The connector set according to claim 1, wherein each of the guiding portions of the second connector is provided as a portion of one of the second external terminals.

10. The connector set according to claim 1, wherein each of the guiding portions of the second connector is made of a metal.

11. The connector set according to claim 1, wherein the first connector includes to-be-guided portions, each of the to-be-guided portions being made of a metal, and each of the to-be-guided portions has three surfaces perpendicular to a fitting plane in which the first connector and the second connector are fitted together and a convex surface that connects the three surfaces in a contiguous manner.

12. The connector set according to claim 11, wherein each of the to-be-guided portions of the first connector is provided as a portion of one of the first external terminals.

13. A connector set including a first connector and a second connector configured to face each other to fit together, the first connector including a first internal terminal that includes terminals along a longitudinal direction, a first insulating member that supports the first internal terminal, and first external terminals that are at two ends of the first internal terminal in the longitudinal direction, the second connector including a second internal terminal that includes terminals along a longitudinal direction and is configured to engage with the first internal terminal of the first connector, a second insulating member that supports the second internal terminal, and second external terminals that are at two ends of the second internal terminal in the longitudinal direction, wherein the first connector includes projecting portions that project further toward the second connector than the first internal terminal does in a direction in which the first connector and the second connector are fitted together, and each of the projecting portions of the first connector is provided as a portion of one of the first external terminals, and the second connector includes recesses in which the projecting portions of the first connector are accommodated and guiding portions, each of the guiding portions having an inclined surface inclined from the top surface of the second external terminal to a respective one of the recesses.

14. The connector set according to claim 13, wherein each of the guiding portions surrounds a respective one of the recesses.

15. The connector set according to claim 14, wherein the inclined surface is continuous surface surrounding the respective one of the recesses.

16. The connector set according to claim 14, wherein each of the guiding portions of the second connector has a plurality of inclined surfaces, the inclined surfaces being on three sides surrounding the respective one of the recesses.

17. The connector set according to claim 13, wherein the guiding portions each project further toward the first connector than the second internal terminal does in the direction in which the first connector and the second connector are fitted together.

18. The connector set according to claim 13, wherein in the direction in which the first connector and the second connector are fitted together, a difference in height between each of the projecting portions of the first connector and the first internal terminal is equal to or larger than a difference in height between the second internal terminal of the second connector and a lower end portion of the inclined surface of each of the guiding portions.

* * * * *